US007055620B2

(12) United States Patent
Nadig et al.

(10) Patent No.: US 7,055,620 B2
(45) Date of Patent: Jun. 6, 2006

(54) HAND-HELD MACHINE TOOL

(75) Inventors: Peter Nadig, Bad Duerkheim (DE); Oliver Zirn, Esslingen (DE); Ludwig Thome, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/297,223

(22) PCT Filed: Feb. 9, 2002

(86) PCT No.: PCT/DE02/00477

§ 371 (c)(1),
(2), (4) Date: Dec. 3, 2002

(87) PCT Pub. No.: WO02/081153

PCT Pub. Date: Oct. 17, 2002

(65) Prior Publication Data

US 2003/0116332 A1 Jun. 26, 2003

(30) Foreign Application Priority Data

Apr. 6, 2001 (DE) ..... 101 17 121

(51) Int. Cl.
*B25D 16/00* (2006.01)

(52) U.S. Cl. ..... 173/2; 173/176; 173/178; 173/217

(58) Field of Classification Search ..... 173/2, 173/176, 5, 6, 178, 181, 217; 408/6, 9, 129, 408/122.5, 120
See application file for complete search history.

(56) References Cited

U.S. PATENT DOCUMENTS 4,063,600 A * 12/1977 Krzes ..... 173/176
4,250,436 A * 2/1981 Weissman ..... 318/245
4,487,270 A * 12/1984 Huber ..... 173/176
4,534,420 A * 8/1985 Goldelius ..... 173/176
4,539,500 A * 9/1985 Houben et al. ..... 310/230
4,546,834 A * 10/1985 Menzel ..... 173/176
4,650,375 A * 3/1987 Millsap ..... 408/6
4,766,963 A 8/1988 Hartwig
4,871,033 A * 10/1989 Odoni et al. ..... 173/178
5,014,793 A 5/1991 Germanton
5,358,062 A * 10/1994 Uhl et al. ..... 175/394
5,401,124 A * 3/1995 Hettich ..... 173/176
5,584,619 A * 12/1996 Guzzella ..... 408/9
5,648,706 A * 7/1997 Polk et al. ..... 318/376
5,672,922 A 9/1997 Raichle et al.
5,677,586 A * 10/1997 Horst ..... 310/103
5,831,402 A * 11/1998 Yang ..... 318/281

(Continued)

FOREIGN PATENT DOCUMENTS

DE 39 38 787 A1 5/1991

(Continued)

*Primary Examiner*—Scott A. Smith
(74) *Attorney, Agent, or Firm*—Michael J. Striker

(57) ABSTRACT

The invention is based on a hand power tool having an electric motor (12) located in a housing (10), via which an insertable tool (16) situated in a tool mount (14) is capable of being driven in a rotating manner, and having a safety device (18) with which a characteristic value for an occurrence of uncontrolled blockage of the insertable tool (16) can be detected via a sensor unit (20), and the movement of the housing (10) can be decelerated.

It is proposed that the safety device (18) is formed at least partially by a motor control unit (22), via which the electric motor (12) can be actively decelerated when an occurrence of uncontrolled blockage of the insertable tool (16) is detected.

4 Claims, 1 Drawing Sheet

U.S. PATENT DOCUMENTS

| | | | | |
|---|---|---|---|---|
| 5,868,208 | A * | 2/1999 | Peisert et al. | 173/48 |
| 5,914,882 | A | 6/1999 | Yeghiazarians | |
| 5,918,685 | A * | 7/1999 | Ulbrich et al. | 173/4 |
| 5,954,457 | A * | 9/1999 | Stock et al. | 408/6 |
| 5,996,707 | A * | 12/1999 | Thome et al. | 173/2 |
| 6,044,918 | A * | 4/2000 | Noser et al. | 173/2 |
| 6,111,515 | A * | 8/2000 | Schaer et al. | 408/6 |
| 6,236,177 | B1 * | 5/2001 | Zick et al. | 318/362 |
| 6,415,875 | B1 * | 7/2002 | Meixner et al. | 173/2 |
| 6,484,814 | B1 * | 11/2002 | Bongers-Ambrosius | 173/2 |
| 6,520,266 | B1 * | 2/2003 | Bongers-Ambrosius et al. | 173/2 |
| 6,651,860 | B1 * | 11/2003 | Artmann et al. | 173/109 |
| 6,758,288 | B1 * | 7/2004 | Richter et al. | 173/217 |

FOREIGN PATENT DOCUMENTS

| | | | |
|---|---|---|---|
| DE | 43 34 933 | A1 | 4/1995 |
| DE | 43 44 817 | A1 | 6/1995 |
| DE | 44 01 686 | C1 | 6/1995 |
| DE | 196 41 618 | A1 | 4/1998 |
| EP | 0 666 148 | A | 8/1995 |
| EP | 0 303 651 | B2 | 12/1999 |

* cited by examiner

HAND-HELD MACHINE TOOL

BACKGROUND OF THE INVENTION

The invention is based on a hand power tool.

A hand power tool is made known in EP 0 303 651 B2, in fact, a hand-guided power drill having an electric motor located in a housing, via which an insertable tool situated in a tool mount or a drill bit is capable of being driven in a rotating manner. The hand power tool comprises a safety device with which an occurrence of "uncontrolled blockage" of the insertable tool is capable of being detected via a sensor, and a driving of the insertable tool can be halted.

An occurrence of uncontrolled blockage occurs when the insertable tool becomes jammed in the work piece to be worked, the reaction torque acting on the housing exceeds an operator's gripping force, and the housing turns, uncontrolled, around an axis with a certain angular velocity and over a certain angular range. If the operator's gripping force is greater than the existing reaction torque, and/or if the operator grips the hand power tool tightly during blockage, this is an occurrence of "controlled blockage".

The safety device on the hand power tool made known in EP 0 303 651 B2 comprises a clutch located in a drive train of the hand power tool for interrupting the rotary-driving action when uncontrolled blockage occurs. Moreoever, the safety device comprises a holding device between the clutch and the insertable tool, via which the drive train is interconnected with the housing when uncontrolled blockage occurs. The holding device is formed by an electrically-actuatable brake.

SUMMARY OF THE INVENTION

The invention is based on a hand power tool having an electric motor located in a housing, via which an insertable tool situated in a tool mount is capable of being driven in a rotating manner, and comprising a safety device with which a characteristic value for an occurrence of uncontrolled blockage of the insertable tool can be detected via a sensor unit, and the movement of the housing can be decelerated.

It is proposed that the safety device is formed at least partially by a motor control unit, via which the electric motor can be actively decelerated if uncontrolled blockage of the insertable tool is detected. An additional braking or blocking unit can be avoided entirely or it can be designed to be particularly space-saving and lightweight. Additional components, weight, installation space, installation expense and costs can be spared. With the safety device having a simple construction, problems associated with reversal and wear on an additional braking device can be prevented. The safety device can basically be used with all hand power tools, the insertable tools of which are capable of being driven in a rotating manner, as is the case, for example, with angle grinders and routers, circular saws, chain saws, etc., and, in particular, with hand-guided power drills, impact drills, and drill hammers.

In principle, all electric motors appearing suitable to one skilled in the art—such as asynchronous motors, synchronous motors, or DC devices, etc., for example—can be actively decelerated via a special motor control unit, via a brake control. Particularly advantageously, the electric motor is formed by an electronically commutated motor, however. Brushless, electronically commutated motors—reluctance motors, in particular—are particularly overload-tolerant and can be loaded for short durations with a high level of torque and, therefore, a high level of braking torque. A high amount of current can flow without the risk of brush sparking.

Furthermore, an armature of the electronically commutated electric motor can be designed having an overall smaller mass due to the absence of an armature winding as compared with an armature of a conventional electric motor having an armature winding. As a result, the armature of the electronically commutated electric motor stores a small amount of rotational energy during operation and can be decelerated rapidly using little energy. The electronically commutated electric motor can be advantageously decelerated with a large intermediate-circuit capacitor or with a brake chopper in a brake circuit.

If a motor control unit is designed at least partially integral with an already-present power control unit of the electric motor, then components, installation space, and weight can be advantageously spared. In the case of electronically commutated motors in particular, the motor control unit can easily be designed integral with a power control unit of the electric motor.

If the motor control unit is combined with a small, space-saving, separate braking unit, the housing can be advantageously decelerated—if uncontrolled blockage occurs—with minimal load on the motor. The separate braking unit can comprise various designs, e.g., it can be formed by a mechanical or an electromechanical unit, etc.

The sensor unit can comprise various sensors appearing suitable to one skilled in the art, e.g., electronic, electromechanical, and/or mechanical sensors, via which, however, it should be possible to detect an angular velocity and an angular acceleration of the housing, as well as an angular range covered by the housing. Particularly advantageously, the sensor unit comprises at least one electronic sensor. Said electronic sensor can be designed to be small and lightweight, and it can be integrated, particularly advantageously, in space-saving fashion in small hand power tools. The information from the sensor to the motor control unit can be transmitted via electric lines, via radio, optically and/or mechanically, etc.

BRIEF DESCRIPTION OF THE DRAWINGS

Further advantages result from the following description of the drawing. An exemplary embodiment of the invention is shown in the drawing. The drawing, the description, and the claims contain numerous features in combination. One skilled in the art will advantageously consider them individually as well and combine them into reasonable further combinations.

DETAILED DESCRIPTION OF THE PREFERRED EMBODIMENTS

Figure 1:
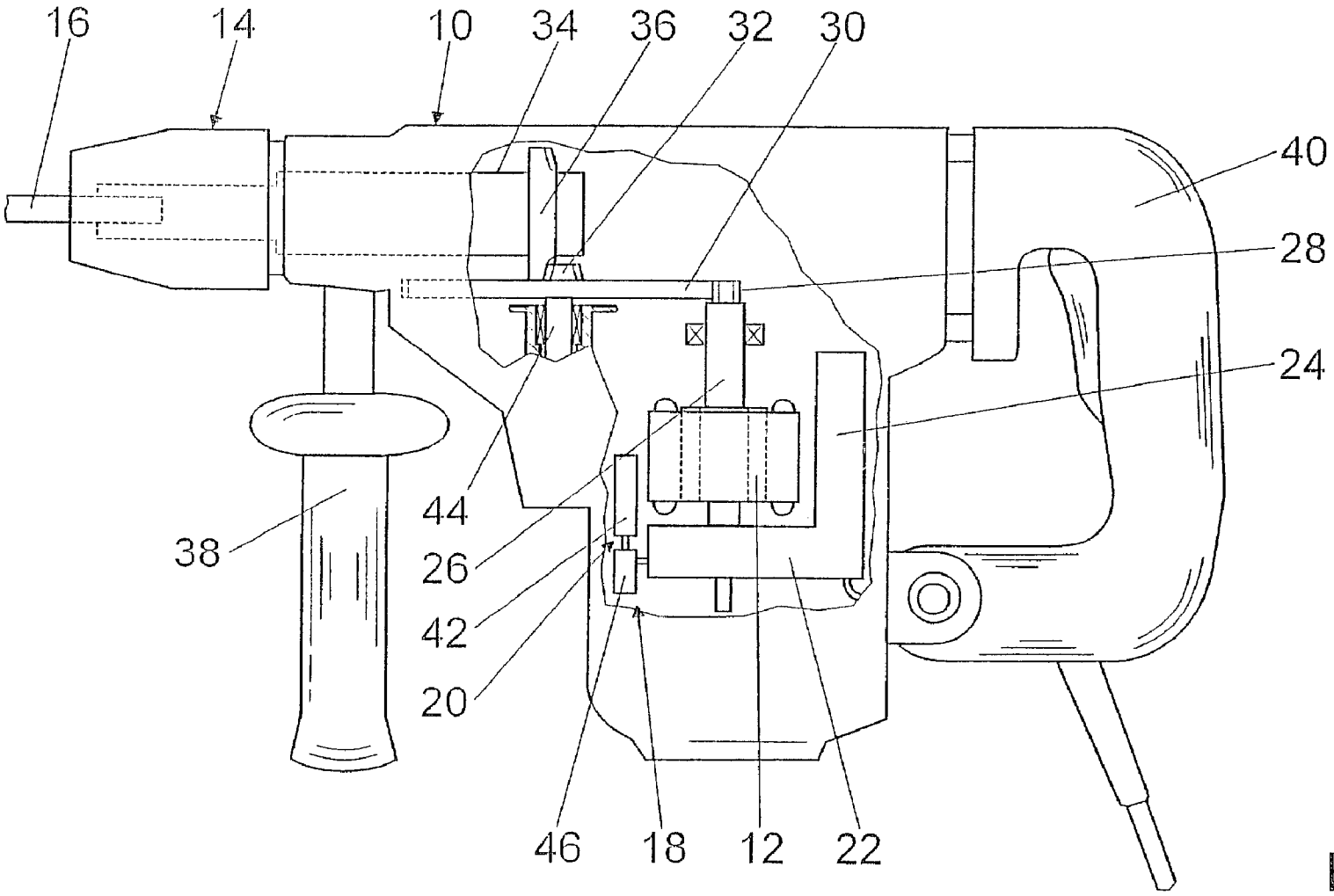

FIG. 1 shows a partial cross-section through a drill hammer comprising an electric motor 12 located in a housing 10 that is formed by an electronically commutated motor. An insertable tool 16 or a drill bit secured in a tool mount 14 is capable of being driven in a rotating manner via the electric motor 12. Furthermore, the drill hammer comprises a safety device 18, with which a characteristic value for an occurrence of uncontrolled blockage of the insertable tool 16 is capable of being detected via a sensor unit 20, and the movement of the housing 10 can be decelerated. According to the invention, the safety device 18 is partially formed by a motor control unit 22, via which the electric motor 12 can be decelerated if an occurrence of uncontrolled blockage of the insertable tool 16 is detected. The motor control unit 22 is designed largely integral with an already-present power control unit 24 of the electric motor 12.

A pinion 28 is formed on an end of a shaft 26 of the electric motor 12 facing an axis of rotation an insertable tool 16, which said pinion meshes with a spur gear 30 supported on a bearing bolt 44. A pinion 32 is formed on an end of the bearing bolt 44 facing the axis of rotation, which said pinion meshes with a ring gear 36 located on a drilling spindle 34. The tool mount 14 is capable of being driven via the drilling spindle 34.

If the insertable tool 16 driven by the drilling spindle 34 becomes blocked, and the gripping force of an operator on two handles 38, 40 of the drill hammer is weaker than a reaction torque occurring on the housing 10, then an amount of torque is transferred from the electric motor 12 via the shaft 26, the gears 28, 30, 32, 36 and the drilling spindle 34 to the housing 10, and the housing 10 is accelerated uncontrollably against the original rotational motion of the insertable tool 16 with a rotational motion around the axis of rotation of the insertable tool 16. This rotational motion is detected by the sensor unit 20 with an electronic acceleration sensor 42 and evaluated with an evaluation unit 46. If a certain angular acceleration and a certain traversed angular range are pressent, a pulse is forwarded from the evaluation unit 46 to the motor control unit 22.

The motor control unit 22 triggers an active deceleration of the electric motor 12, in such a fashion, in fact, that electromagnetically-produced forces of the electric motor 12 act against the direction rotation of the shaft 26. The motor control unit 22 is adjusted in such a fashion and/or it produces via the electric motor 12 a braking torque of such a magnitude that the housing 10 and/or the drill hammer comes to a standstill after an angular range of less than 30° has been covered, and a danger to the operator can be ruled out.

REFERENCE NUMERALS

10 Housing
12 Electric motor
14 Tool mount
16 Insertable tool
18 Safety device
20 Sensor unit
22 Motor control unit
24 Power control unit
26 Shaft
28 Pinion
30 Spur gear
32 Pinion
34 Drilling spindle
36 Ring gear
38 Handle
40 Handle
42 Sensor
44 Bearing bolt
46 Evaluation unit

What is claimed is:

1. A hand power tool having an electric motor (12) located in a housing (10), via which an insertable tool (16) situated in a tool mount (14) is capable of being driven in a rotating manner, and having a safety device (18) with which a characteristic value for an occurrence of uncontrolled blockage of the insertable tool (16) can be detected via a sensor unit (20), and the movement of the housing (10) can be decelerated, wherein the safety device (18) is formed at least partially by a motor control unit (22), via which the electric motor (12) can be actively braked when an occurrence of uncontrolled blockage of the insertable tool is detected, and wherein, by means of the electric motor (12), the housing (10) is actively breakable via the insertable tool (16) in the case of uncontrolled blockage and wherein for actively braking the housing (10) in the case of uncontrolled blockage, the electric motor (12) is capable of actively generating a torque that acts opposite to a direction of rotation of the insertable tool (16), said motor (12) being formed as a brushless, electronically commutated reluctance motor.

2. The hand power tool according to claim 1, wherein the motor control unit (22) is designed at least partially integral with an already-present power control unit (24) of the electric motor (12).

3. The hand power tool according to claim 1, wherein the safety device comprises a separate braking unit.

4. The hand power tool according to claim 1, wherein the sensor unit (20) comprises at least one electronic sensor (42).

* * * * *